US005256267A

United States Patent [19]

Roden

[11] Patent Number: 5,256,267

[45] Date of Patent: Oct. 26, 1993

[54] RESISTORED SACRIFICIAL ANODE ASSEMBLY FOR METAL TANK

[75] Inventor: James S. Roden, Montgomery, Ala.

[73] Assignee: Rheem Manufacturing Company, New York, N.Y.

[21] Appl. No.: 4,724

[22] Filed: Jan. 14, 1993

[51] Int. Cl.[5] ..... C23F 13/00

[52] U.S. Cl. ..... 204/196; 204/280; 126/373; 126/377; 138/DIG. 6; 174/74 A; 174/74 R; 174/82; 174/138 F

[58] Field of Search ..... 204/196, 197, 280; 126/344, 373, 374, 377; 138/DIG. 6; 174/74 A, 74 R, 82, 138 F

[56] References Cited

U.S. PATENT DOCUMENTS

| | | | |
|---|---|---|---|
| 2,453,865 | 11/1948 | Schmidt | 201/67 |
| 2,486,871 | 11/1949 | Osterheld | 204/197 |
| 2,568,594 | 9/1951 | Robinson | 204/197 |
| 2,616,844 | 11/1952 | Klumb | 204/197 |
| 2,656,314 | 10/1953 | Osterheld | 204/197 |
| 2,666,027 | 1/1954 | Vallett | 204/197 |
| 2,740,757 | 4/1956 | Craver | 204/197 |
| 2,748,250 | 5/1956 | Andrus | 219/38 |
| 2,779,729 | 1/1957 | Jorgensen | 204/197 |
| 2,934,485 | 4/1960 | Sabins | 204/197 |
| 2,999,800 | 9/1961 | Reeside | 204/196 |
| 3,412,358 | 11/1968 | Hummel et al. | 338/7 |
| 3,469,226 | 9/1969 | Solow | 338/252 |
| 3,718,573 | 11/1971 | Bidwell | 204/297 |
| 3,891,530 | 6/1975 | Alewitz | 204/197 |
| 4,093,529 | 6/1978 | Strobach | 204/197 |
| 4,486,288 | 12/1984 | Linder | 204/147 |

FOREIGN PATENT DOCUMENTS

| | | |
|---|---|---|
| 0031167 | 1/1973 | Australia . |
| 0036865 | 6/1973 | Australia . |
| 0497380 | 11/1953 | Canada . |

*Primary Examiner*—Kathryn Gorgos
*Attorney, Agent, or Firm*—Konneker, Bush & Hitt

[57] ABSTRACT

A sacrificial anode assembly is insertable into a metal water storage tank to inhibit corrosion thereof and includes a cylindrical metal anode member having an end retained within a cylindrical plastic insulating sleeve which, in turn, is captively retained within a metal cap portion of the assembly. To regulate the amount of electrical current generated by the assembly during use thereof, a barrel-shaped resistor is supported within the assembly and interconnected between its anode and cap portions. The insulating sleeve has a generally U-shaped groove formed in a closed end thereof, with one leg of the groove extending diametrically across a central opening in the sleeve end that receives a core wire portion of the anode member, and the other groove leg extending generally chordwise relative to the sleeve end. The resistor body is received within the chordwise groove leg, and a lead wire of the resistor is extended through the curved and diametrically extending groove portions and spot welded to the core wire portion received in the central sleeve end opening. The configuration of the groove and the relative orientation of the resistor and sleeve opening causes the bent lead wire to form a resilient connection between the spot weld and the resistor body, thereby substantially reducing vibrational fatigue stress on the spot weld during shipping and handling of a tank having the anode assembly operatively installed thereon.

10 Claims, 1 Drawing Sheet

RESISTORED SACRIFICIAL ANODE ASSEMBLY FOR METAL TANK

BACKGROUND OF THE INVENTION

The present invention relates generally to anode devices used to inhibit corrosion in metal water heater tanks and other metal liquid storage vessels and, in a preferred embodiment thereof, more particularly relates to a specially designed resistored anode assembly useful in this corrosion-inhibiting application.

Conventional metal water heater tanks, like other types of metal vessels used to store liquids, are subject to corrosion during use. To inhibit this corrosion, sacrificial anodes, normally constructed of magnesium, aluminum or zinc, are inserted into the tank. The sacrificial anode is slowly consumed during the corrosion protection process while generating an electrical current. As the anode is slowly depleted, its simultaneously generated electrical current cathodically protects the tank against corrosion.

The service life of the anode tends to be inversely dependent upon the amount of electrical current it generates in cathodically protecting the tank. In many fresh water supplies, particularly those having a high mineral content, the current flow generated by the anode is relatively high, resulting in a corresponding decrease in the useful life of the anode. In order to control the rate of consumption of a sacrificial anode, various anode constructions have been proposed in which a resistor is incorporated in the anode, and electrically connected between the anode and its protected tank, to automatically regulate the electrical current generated by the anode during its operation and thereby increase the service life of the anode.

While these resistored anode devices typically extended anode life, many of them also tended to be of a relatively complex construction, rather difficult to assemble, and relatively expensive to fabricate.

Many of these problems are essentially eliminated by a prior art sacrificial anode assembly that incorporates, in a simplified manner, an ordinary barrel-type carbon resistor into the interior of the assembly. This prior art anode assembly includes a cylindrical plastic insulating sleeve captively retained within the metal cap portion of the anode assembly and having a closed end with a central opening through which an end portion of the metal anode body core rod extends. A diametrically extending groove, which intersects the central sleeve opening, is formed in the closed sleeve end.

The cylindrical resistor body is disposed in a radial portion of the sleeve end groove, with one of the resistor end leads being radially extended over the anode rod end and soldered thereto. The other resistor end lead passes through an axially extending exterior side surface groove in the insulating sleeve and is soldered at its outer end to an external metal cap portion of the anode assembly.

Although this method of operatively positioning a resistor in a sacrificial anode assembly provides a worthwhile reduction in assembly time and cost, and provides the desired regulation of anode current generation, it has been found that it can create a problem relating to the structural integrity of the completed anode assembly. Specifically, it has been found that in certain shipping orientations of the tank in which the anode assembly is installed, harmonic vibrations may be created within the central anode core rod which are transmitted to the solder joint connecting a resistor end lead to the rod. These vibrations can fatigue and break the rod/lead solder joint, thereby rendering the anode assembly inoperative.

From the foregoing, it can be seen that it would be desirable to provide a sacrificial anode assembly, of the type having an insulating sleeve-installed resistor as generally described above, which substantially eliminates this vibration-caused solder joint breakage problem. It is accordingly an object of the present invention to provide such a sacrificial anode assembly.

SUMMARY OF THE INVENTION

In carrying out principles of the present invention, in accordance with a preferred embodiment thereof, a specially designed resistored sacrificial anode assembly is provided for use in a metal liquid storage to inhibit vessel corrosion.

The anode assembly may be secured to the vessel, to extend into its liquid filled interior, and includes an elongated metal anode member having a core wire extending longitudinally therethrough and projecting outwardly through an end thereof. An insulating sleeve member, preferably formed from a molded plastic material, receives and is captively retained on this anode member end and has an end wall portion with a central opening therein that receives an end portion of the core wire. A hollow metal cap member received and is captively retained on the insulating sleeve member.

An electrical resistor is disposed within the cap member and has a cylindrical body portion with first and second ends. First and second electrical lead wires respectively extend outwardly from the first and second resistor body ends.

Exterior surface groove means are formed in the end wall portion of the insulating sleeve member and receive the resistor body in a manner positioning its length perpendicular to the longitudinal axis of the insulating sleeve. These groove means have a curved portion through which the first electrical lead wire extends to the core wire end portion, the groove means being configured to permit lateral movement of the first electrical lead wire therein. Means, representatively in the form of a spot weld, are provided for fixedly and conductively securing an outer end portion of the first electrical lead wire to the core wire end portion.

Because of the unique configuration of the groove means, the bent first electrical lead wire received therein forms a resiliently deflectable interconnection between the spot weld and the resistor body. Accordingly, lateral vibrational forces created in the core wire (arising, for example, during shipping and handling of the vessel within which the anode assembly is incorporated) are not rigidly resisted by the first electrical lead wire. Instead, the bent first electrical lead wire is caused to laterally flex within the groove means in response to lateral vibrational movement of the core wire end portion, thereby protecting the lead wire/core wire spot weld against fatigue stress breakage.

Means are also provided for fixedly and conductively securing an outer end portion of the second electrical lead wire to the metal cap member. In a preferred form thereof, these means include an exterior side surface groove formed on the insulating sleeve and receiving the second resistor electrical lead member, and a spot weld securing an outer end portion of the second lead member to an open end portion of the cap member.

DETAILED DESCRIPTION

Figure 1:
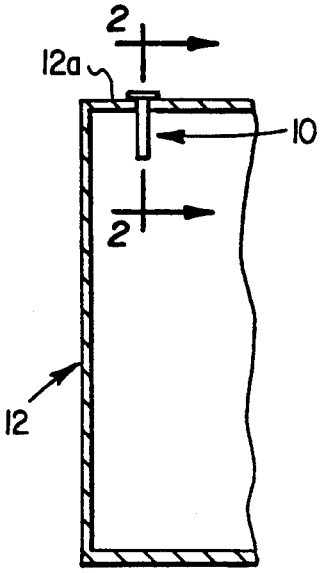
FIG. 1 is a schematic partial cross-sectional view through a representative metal water heater tank having operatively installed on a top end thereof a resistored sacrificial anode assembly embodying principles of the present invention.

Referring to FIGS. 1-4, the present invention provides a specially designed resistored sacrificial anode assembly 10 which is operatively installed in the top end wall 12*a* of a representative metal water heater storage tank 12, extends into the water-filled interior of the tank, and operates to cathodically inhibit corrosion of the tank. As cross-sectionally illustrated in FIG. 2, the anode assembly 10 includes a cylindrically shaped sacrificial anode member 14 having a main body portion 16, a reduced diameter neck portion 18 having an annular external side surface indentation 20 formed therein, and an annular ledge 22 formed at the juncture of the main body and neck portions 16,18. Axially extending centrally through the anode member 14 is a metal core wire or rod 24 having an upper end portion 24*a* extending upwardly beyond the upper end of the neck portion 18.

The anode member neck portion 18 is coaxially pressed into the open lower end 26 of a cylindrical, molded plastic insulating sleeve 28 having a closed top end 30 through which a central circular hole 32 is formed. When the anode neck 18 is pressed into sleeve 28, the wire end portion 24*a* is received in the hole 32.

Figure 2:
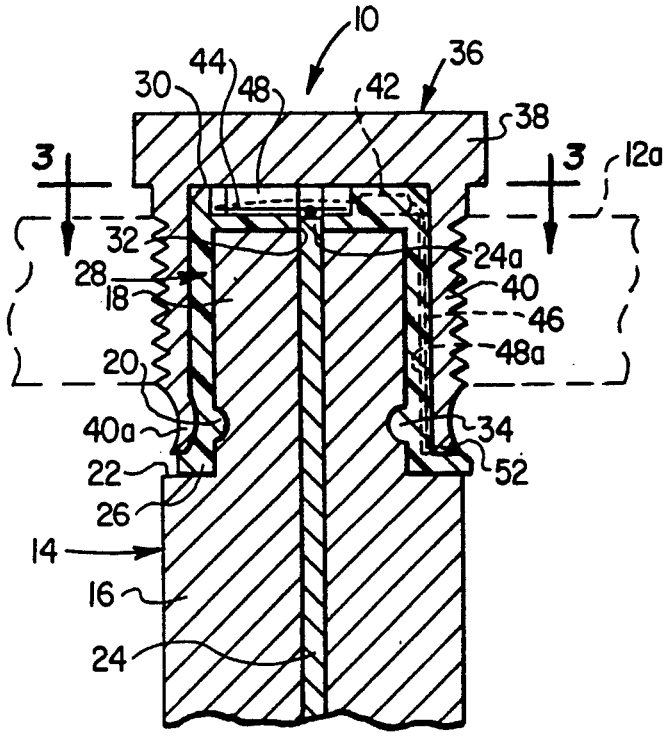
FIG. 2 is an enlarged scale partial cross-sectional view through the anode assembly taken along line 2—2 of FIG. 1.

Sleeve 28, in turn, is pressed into a hollow cylindrical metal cap member 36 having an enlarged diameter head portion 38, and a hollow externally threaded body portion 40 threaded into the top tank end wall 12*a* as shown in FIG. 2. A lower end portion 40*a* of the body portion 40 is inwardly swaged against the body of the plastic sleeve 28 to captively retain the sleeve 28 within the cap member body 40. This swaging also forces an annular portion 34 of the sleeve 28 into the annular groove 20.

Figure 3:
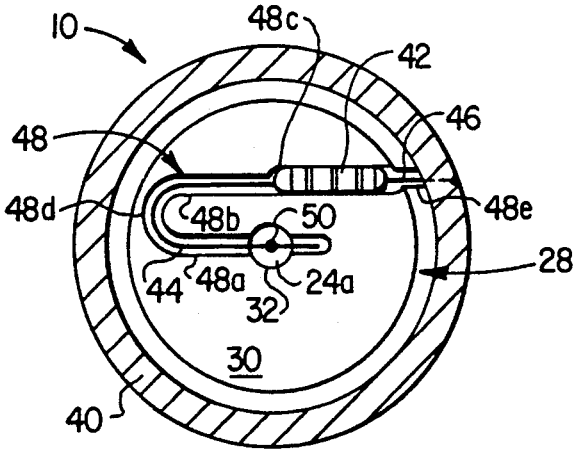
FIG. 3 is a cross-sectional view through the anode assembly taken along line 3—3 of FIG. 2.
Figure 4:
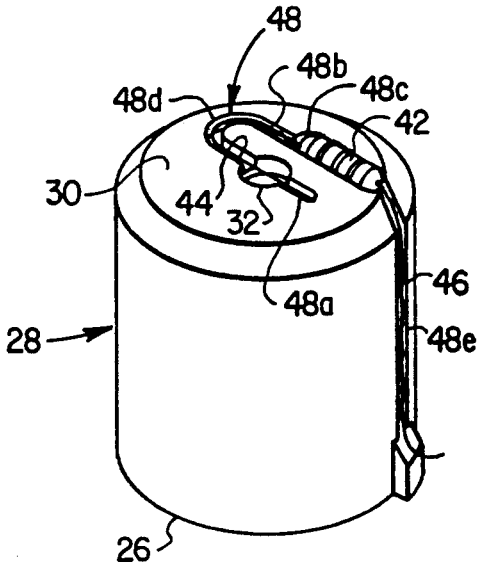
FIG. 4 is a perspective view of an internal plastic insulating sleeve portion of the anode assembly.

To control and maintain the protective anode current at a suitable level, the anode assembly 10 is provided with a barrel-shaped resistor 42 (see FIGS. 3 and 4) having metal lead wires 44 and 46 extending outwardly from its opposite ends. To support the resistor 42 on the top end of the sleeve 28, a specially configured exterior surface groove 48 is formed in the sleeve. As best illustrated in FIGS. 3 and 4, the groove 48 has a portion 48*a* extending diametrically across the closed top sleeve end 30 from opposite sides of the circular sleeve opening 32; a portion 48*b* extending generally chordwise across the sleeve end 30 and having a transversely enlarged portion 48*c*; a curved portion 48*d* joining adjacent left ends of portions 48*a* and 48*b*; and a portion 48*e* extending axially along the external side surface of the sleeve 28 from the right end of the groove portion 48*b*.

Accordingly, the exterior groove 48 sequentially extends upwardly along the body of the sleeve, across the top end of the sleeve in a chordwise direction, bends around at groove portion 48*d*, and then extends diametrically across the top sleeve end opening 32. The chordwise groove portion 48*c* is representatively illustrated as being parallel to the diametrically extending groove portion 48*a*. However, groove portion 48*c* could be oriented at an angle to groove portion 48*a* if desired.

The groove portions 48*a*–48*c* on the top end of the sleeve 28 are vertically deeper than the resistor 42 (see FIG. 2), all of the groove portions 48*a*–48*e* are laterally wider than the resistor leads 44 and 46, and the horizontal width and length of the laterally enlarged groove portion 48*c* are sized to permit the resistor 42 to be snap-fitted into the groove portion 48*c* to inhibit movement of the resistor relative to the groove portion 48*c*. Alternatively, the groove portion 48*c* could be configured to permit at least limited movement of the resistor within the groove portion 48*c*.

Prior to the insertion of the sleeve 28 within the body portion 40 of the cap member 36, the resistor 42 is snap-fitted into the laterally enlarged groove portion 48*c*; the resistor lead 44 is extended along the groove portions 48*b*,48*d* and 48*a* and spot welded to the core wire portion 24*a* as at 50 (see FIG. 3); and the resistor lead wire 46 is extended downwardly through the vertical groove portion 48*e*. After the anode member-supported sleeve 28 is operatively inserted into the body of the cap member 36, the outer end of the lead 46 is spot welded, as at 52 (see FIG. 2), to the lower end of the cap member body portion 40. The completed anode assembly 10 is then ready to be threaded into the tank wall 12*a* as illustrated in FIG. 2.

In prior art anode insulating sleeves similar to sleeve 28, the resistor is fixedly held in a diametrically extending groove formed in the closed sleeve end. Using this conventional resistor support configuration, the upper end of the anode core wire, and thus the core wire/lead wire spot weld, is longitudinally aligned with the cylindrical resistor body fixedly held on the closed sleeve end. Accordingly, lateral vibrational movements of the core wire are axially resisted by the resistor lead wire welded thereto which, with respect to such lateral vibrational movements of the core wire, forms an essentially rigid connection between the spot weld and the facing end of the resistor body. This essentially rigid connection between the spot weld and the facing resistor body end can fatigue and break the spot weld, the lead wire, or the resistor body, thereby undesirably breaking the electrical current path between the anode core wire and the metal anode cap.

In sharp contrast, due to the unique configuration of the top sleeve end portion of the groove 48 in the present invention, rigid vibrational forces transmitted to the spot weld 50 (see FIG. 30) from the core wire (arising, for example, when the tank 12 is shipped in a horizontal orientation) are substantially eliminated. This desirable result is achieved via the lateral shifting of the resistor 42 out of axial alignment with the groove portion 48*a*, and the generally U-shaped configuration of the connected groove portions 48*a*,48*b*,48*d*.

Specifically, it can be seen in FIGS. 3 and 4 that the spot weld 50 is resiliently connected to the left end of the resistor 42 by the generally U-shaped lead wire 44 received in the connected groove portions 48*a*,48*b*,48*d*. A vibrational shift of the spot weld 50 to the left as viewed in FIG. 3 is not met with a rigid lead wire resistance. Instead, such leftward vibrational shift of the spot weld 50 simply causes the bent portion of the lead wire 44 to resiliently flex, and shift leftwardly within its groove portion 48*d*, without exerting an appreciable axial force on the resistor 42. In a similar manner, a vibrational shift of the spot weld 50 to the right is not met with a rigid lead wire resistance. Instead, such rightward vibrational shift of the spot weld 50 simply causes the bent portion of the lead wire 44 to resiliently flex, and shift rightwardly within its groove portion 48*d*, without exerting an appreciable axial force on the resistor 42.

This resilient lead wire interconnection between the spot weld 50 and the resistor 42 thus advantageously functions to protect the weld against vibrational fatigue breakage. The top sleeve end groove modification embodied in the present invention may be easily and inexpensively incorporated into the anode assembly 10 to appreciably increase both its durability an reliability.

The foregoing detailed description is to be clearly understood as being given by way of illustration and example only, the spirit and scope of the present invention being limited solely by the appended claims.

What is claimed is:

1. A sacrificial anode assembly insertable into a liquid storage vessel and operative to cathodically inhibit corrosion thereof, said sacrificial anode assembly comprising;

an elongated metal anode member having a core wire extending axially therethrough and projecting outwardly through an end of said anode member;

an insulating sleeve member receiving and being captively retained on said end of said anode member, said insulating sleeve member having:

an end wall portion with a central opening that receives an end portion of said core wire, and an exterior surface groove formed in said end wall portion and having a first generally straight section extending into said central opening and having an end spaced apart therefrom, a second generally straight section offset from said first section and having an end spaced apart from said central opening, and a curved third section joining said ends of said first and second sections;

a hollow metal cap member receiving and captively retained on said insulating sleeve member; and an electrical resistor having:

a cylindrical body portion received in said second section of said groove in a spaced apart relationship with said end thereof, a first electrical lead wire extending from one end of said resistor body portion sequentially through a portion of said second groove section, said curved third groove section, said first groove section, and across said central opening, said first electrical lead wire having an outer end portion fixedly and conductively secured to said end portion of said core wire, and a second electrical lead wire extending from the opposite end of said resistor body portion and being fixedly and conductively secured to said cap member.

2. The sacrificial anode assembly of claim 1 wherein:

said first groove section has a laterally enlarged portion that receives said resistor body portion and is configured to essentially prevent movement thereof relative to said insulating sleeve member.

3. The sacrificial anode assembly of claim 1 wherein:

said outer end portion of said first lead wire is spot welded to said end portion of said core wire.

4. The sacrificial anode assembly of claim 1 wherein:

said insulating sleeve member has a generally cylindrical configuration, said first groove section extends generally diametrically across said end wall portion of said insulating sleeve member, and said second groove section extends generally chordwise across said end wall portion of said insulating sleeve member.

5. The sacrificial anode assembly of claim 4 wherein:

said insulating sleeve member has a side wall portion generally perpendicular to said end wall portion, said side wall portion having an exterior side surface groove thereon which communicates with said second groove section, longitudinally extends generally perpendicularly thereto, and receives said second lead wire.

6. The sacrificial anode assembly of claim 1 wherein:

said insulating sleeve member is molded from a plastic material.

7. An insulating sleeve for use in a resistored sacrificial anode assembly, said insulating sleeve having:

a hollow cylindrical body portion having an open first end and a second end across which an end wall portion extends, said end wall portion having a central opening extending therethrough; and an exterior surface groove having:

a first section formed on said end wall portion and extending generally diametrically to said central opening, said first section having a first end spaced outwardly apart from said central opening, a second section formed on said end wall portion and extending generally chordwise therealong, said second section having first and second ends and a portion disposed therebetween and configured to receive and support the cylindrical body portion of an electrical resistor having a pair of end leads, a curved third section .formed on said end wall portion and interconnecting said first ends of said first and second sections, and a fourth section defining a continuation of said second section from said second end thereof and extending generally axially along said cylindrical body portion of said insulating sleeve.

8. The insulating sleeve of claim 7 wherein:

said insulating sleeve is formed from a molded plastic material.

9. The insulating sleeve of claim 7 wherein:

said first and second groove sections are generally parallel to one another.

10. A sacrificial anode assembly comprising:

an elongated metal anode member having a core wire extending longitudinally therethrough and projecting outwardly through an end thereof;

an insulating sleeve member receiving and being captively retained on said end of said anode member, said insulating sleeve member having an end wall portion with a central opening that receives an end portion of said core wire;

a hollow metal cap member receiving and captively retained on said insulating sleeve member;

an electrical resistor disposed within said hollow metal cap member and having a cylindrical body portion with first and second ends, and first and second electrical lead wires respectively extending outwardly from said first and second resistor body portion ends;

exterior surface groove means formed in said end wall portion of said insulating sleeve member, said exterior surface groove means receiving said electrical resistor body portion in a manner positioning it perpendicularly to said insulating sleeve member, and having a curved portion through which said first electrical lead wire extends to said core wire end portion, said groove means being configured to permit lateral movement of said first electrical lead wire therein;

means for fixedly and conductively securing an outer end portion of said first electrical lead wire to said core wire end portion, whereby lateral vibrational forces created in said core wire are resiliently absorbed within a bent portion of said first electrical lead wire disposed within said curved portion of said exterior surface groove means; and means for fixedly and conductively securing an outer end portion of said second electrical lead wire to said metal cap member.

* * * * *